United States Patent [19]

Nakane

[11] 3,975,994

[45] Aug. 24, 1976

[54] APPARATUS FOR PRODUCING PACKING CASES

[75] Inventor: Jun Nakane, Chiba, Japan

[73] Assignees: Bandamatic System Services Kabushiki Kaisha; Sekisui Jushi Kabushiki Kaisha, both of Osaka, Japan

[22] Filed: Dec. 19, 1973

[21] Appl. No.: 426,078

[52] U.S. Cl. ..... 93/51 HW; 93/47; 93/49 R; 93/58.3; 93/59 MT; 425/299

[51] Int. Cl.[2] ..... B31B 1/22; B31B 1/52

[58] Field of Search ..... 83/171; 425/298, 299, 425/385, 291, 324; 93/49 R, 51 R, 47, 59 MT, 59 ES, 58.3, 58 R, 58 ST, 51 HW

[56] References Cited

UNITED STATES PATENTS

| | | | |
|---|---|---|---|
| 2,589,022 | 3/1952 | Page, Jr. et al | 425/298 X |
| 2,843,027 | 7/1958 | Sevison | 425/385 X |
| 3,000,275 | 9/1961 | Sevison | 425/385 X |
| 3,101,653 | 8/1963 | Burden | 93/49 R |
| 3,247,769 | 4/1966 | Stannard | 93/49 R |
| 3,385,177 | 5/1968 | Waterhouse | 93/49 R |
| 3,729,887 | 5/1973 | Reeves | 93/59 R X |

*Primary Examiner*—James F. Coan
*Attorney, Agent, or Firm*—Oblon, Fisher, Spivak, McClelland & Maier

[57] ABSTRACT

A packing case or box having a bottom, opposing lateral side walls, opposing longitudinal side walls and upper side walls, or fixed flaps, at opposing edges of the lateral side walls is produced from a blank piece of thermoplastic material, and an apparatus is provided for producing the packing case which is operated to perform the steps of melting and cutting unnecessary portions for forming the case by pressing a heated die upon the sheet of stock and at the same time impressing scorings or grooves upon the stock to be folded, folding the portions of the side walls and the fixed flaps defined by the scorings or grooves immediately after withdrawal of the heated die from the stock, and welding the heated and melted end walls of the connecting side portions of the stock in a folded position while the stock is in its molten state.

9 Claims, 13 Drawing Figures

APPARATUS FOR PRODUCING PACKING CASES

BACKGROUND OF THE INVENTION

1. Field of the Invention:

The present invention relates generally to packing boxes and more particularly to a packing case made of a sheet of foamed or expanded thermoplastic material or a sheet of thermoplastic corrugated board and an apparatus for producing the same.

2. Description of the Prior Art:

It generally is comparatively easy to produce a square box without a lid from a sheet of plastic material, however, conventional boxes of this character which are commonly known in the art do not have enough strength against torsional forces and are therefore easily deformed by only slight external forces. Further, especially in the case of bulky boxes, they are liable to slip from one's grasp because of the physical nature of the material and they are therefore inconvenient to carry. Also, in such boxes having no lids and being common in shape, there is the problem in storing in that the boxes can not be piled or stacked very high because the stacking surfaces thereof are not planar. In order to prevent deformation of the boxes, which is one of the principal defects in the case of such conventional types, reinforcing members or overlapping areas to which paste is applied may be provided. However, these steps are not advisable, because they not only cause the thickness of the side walls of the box to be uneven, but they also require the use of additional materials for making the reinforcing members or the overlapping areas. Further, these steps still do not make it possible to stack such boxes one above another.

SUMMARY OF THE INVENTION

Accordingly, it is an object of the present invention to provide an improved packing case or box having no lid, which is light in weight, and in which each of the walls thereof is even in thickness along the entire surfaces thereof.

Another object of the present invention is to provide a packing case or box which is resistant to deformation or twisting without relying on reinforcing members or adhesive agents which also is capable of stacking one upon the other, and yet is strong and convenient to carry.

Still another object of the present invention is to provide an apparatus for automatically producing a packing case or box which is provided with upper side walls at opposing upper edges thereof by folding a blank sheet of stock of the same thickness and by welding the connecting portions of the box.

Briefly, the foregoing and other objects are attained in accordance with the present invention by the provision of a packing case or box having upper side walls, hereinafter referred to as flaps or fixed flaps, at opposing edges of a square box which may be produced from a blank piece of thermoplastic material, and an apparatus for producing the packing case which is operated to perform the steps of melting and cutting unnecessary portions for forming the case by pressing a heated die upon the sheet of the stock and at the same time impressing scorings or grooves upon the stock to be folded, folding the portions of the side walls and the fixed flaps defined by the scorings or grooves on the stock immediately after withdrawal of the heated die from the stock, and welding heated and melted end walls of the connecting side portions of the stock in a folded position while the stock is in its molten state.

BRIEF DESCRIPTION OF THE DRAWINGS

Various other objects, features and attendant advantages of the present invention will be more fully appreciated as the same becomes better understood by reference to the following detailed description when considered in connection with the accompanying drawings, wherein like reference numerals designate like or corresponding parts throughout the several views, and in which.

DETAILED DESCRIPTION OF THE PREFERRED EMBODIMENTS

Figure 1:
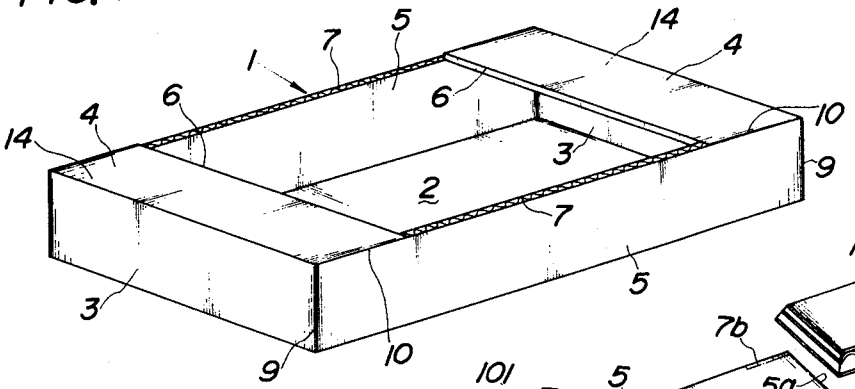
FIG. 1 is a perspective view of an assembled packing case formed in accordance with the present invention.

Referring now to the drawings, and more particularly to FIGS. 1 to 5 thereof, the packing case, generally indicated by the reference numeral 1 of the present invention is shown as including a bottom wall 2, opposing lateral side walls 3, opposing longitudinal side walls 5, and flaps or folds 4 extending from the side walls 3. Each of the corners 9 of the case or box 1 is welded by joining melted edges of the respective adjacent side walls 3 and 5 together as hereinafter described, and the flaps 4 are folded inward so as to cover the right and left sides of the case 1, defining an opening therebetween, and are respectively welded to the upper edges 7b of the two longitudinal side walls 5 at their edges 4a to form fixed flaps 14 at the upper surface of the case.

Figure 3:
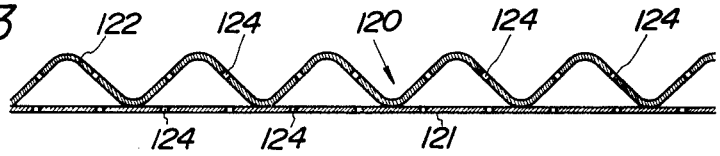
FIGS. 3–5 are enlarged sectional views of a corrugated board having ventilating holes therein which is used for forming the packing case in accordance with the present invention.
Figure 4:
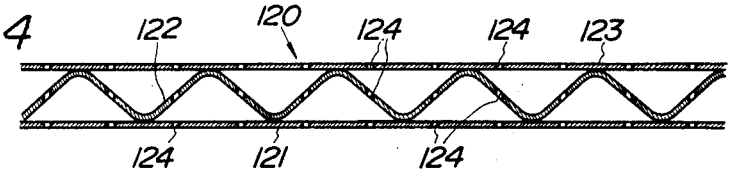
Figure 5:
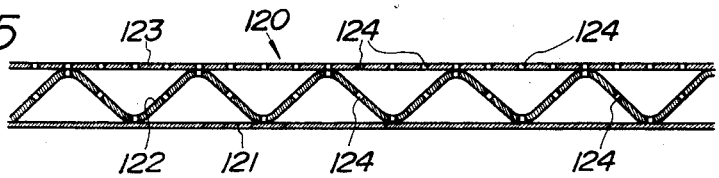

The stock used for the packing case of the present invention is preferably a sheet of foamed or expanded thermoplastic synthetic resin or thermoplastic corrugated board, such as, for example, polyvinyl chloride, ABS resin, polyethylene, polypropylene, polystyrene, polyamide and the like. As shown in FIGS. 3 – 5, the corrugated board adapted to be used in the present invention, which is generally indicated by the reference numeral 120, may be of either a conventional shape consisting of a first liner 121, a medium web 122 and a second liner 123, as shown in FIGS. 4 and 5, or a single face type eliminating the second liner as shown in FIG. 3. Also, while the medium web 122 may be of any shape, a plurality of holes 124 are preferably perforated in the first and/or second liners 121 and 123 and the medium web 122 for the purpose of providing ventilation so as to be able to use the packing case conveniently in the transportation and preservation of agricultural or marine products. In FIG. 5, a double faced corrugated board without ventilating holes 124 in the first liner 121 is shown.

Referring now to the apparatus for producing the packing case 1 in accordance with the present invention, and more particularly to FIGS. 6–13, a work table generally indicated by the reference numeral 400 is shown having a chuck plate, generally indicated by reference numeral 200, disposed thereabove for holding the thermoplastic sheet 100 on the work table 400 during the operation of forming the case, and also a heated die, generally indicated by the reference numeral 300, for scoring and removing unnecessary portions of the sheet 100.

As is more clearly shown in FIG. 9, the work table 400 consists of eight plates which are respectively hinged at upright supporting frames 410 fixed on a base 490, shown in FIG. 6, so as to be able to fold upwardly and downwardly, and it includes fittings associated with these plates and actuating means for these plates and fittings, which are described in greater detail hereinafter. More specifically, four of the plates 412, 412, 414 and 414 which support the bottom 2 of the packing case 1, are hinged to the fixed supporting frames 410 by pivot pins 411 connected through hinged arms 413 for plates 412 and 415 for plates 414. Oppositely disposed plates 416 are positioned outside the plates 412 for folding the lateral side walls 3 and the extension flaps 4 of the case 1 and oppositely disposed plates 418 are positioned outside plates 414 for folding the side walls 5 of the case 1, being respectively hinged at the same pivot pins 411 through respective connecting hinged arms 417 and 419 thereof. The plates 416 for folding the side walls 3 and the extension flaps 4 of the case 1 are each provided with elongated parallel slots 420 in which guide plates 421 having an arcuate inner surface for guiding the flaps 4 to be bent are adjustably secured through bracket portions 423 thereon by bolts 424. The curved inner surface 422 of the arcuate guide plates 421 is best shown in FIG. 10.

Figure 11:
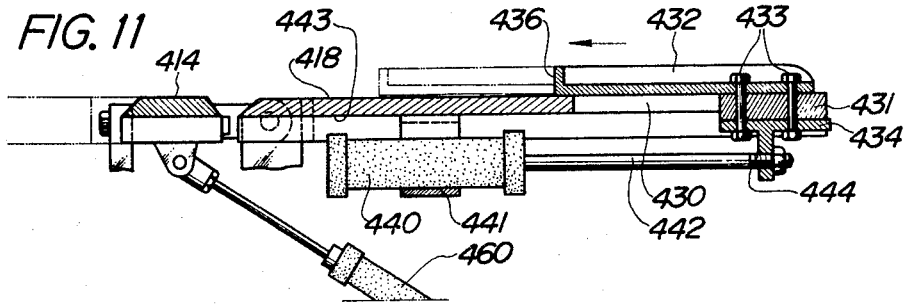
FIG. 11 is an enlarged sectional view taken along the line 11—11 of FIG. 9, showing sliding plates associated with fold plates of the work table, which press the flap to be welded at the upper edges of the case.

As shown in FIG. 11, the plates 418 for folding up the longitudinal side walls 5 of the case 1 are respectively provided with guide channels 430 in which sliders 431 securing flap pressing plates 432 and brackets 434 together by bolts 433 are slidably disposed. At the back surfaces 443 of the side wall folding plates 418, cylinders 440 for actuating the flap pressing plates 432 are mounted, the cylinder rods 422 thereof being connected to the sliders 431. The side wall folding plates 416 and 418 can be erected to an upright position by cylinders 450, the rods 451 of which are pivotally connected at one end through pins 452 to brackets 453 on the folding plates. The cylinders 450 in turn are pivotally connected at their opposite ends through pins 454 to brackets 455 on the base. The bottom wall supporting plates 412 and 414 are retracted downwardly by cylinder 460, the rods 461 of which are pivotally connected at one end through pins 462 to brackets 463 on the supporting plates. These cylinders 460 in turn are pivotally connected at their other ends through pins 464 to brackets 465 mounted on the main supporting base of the apparatus.

Figure 7:
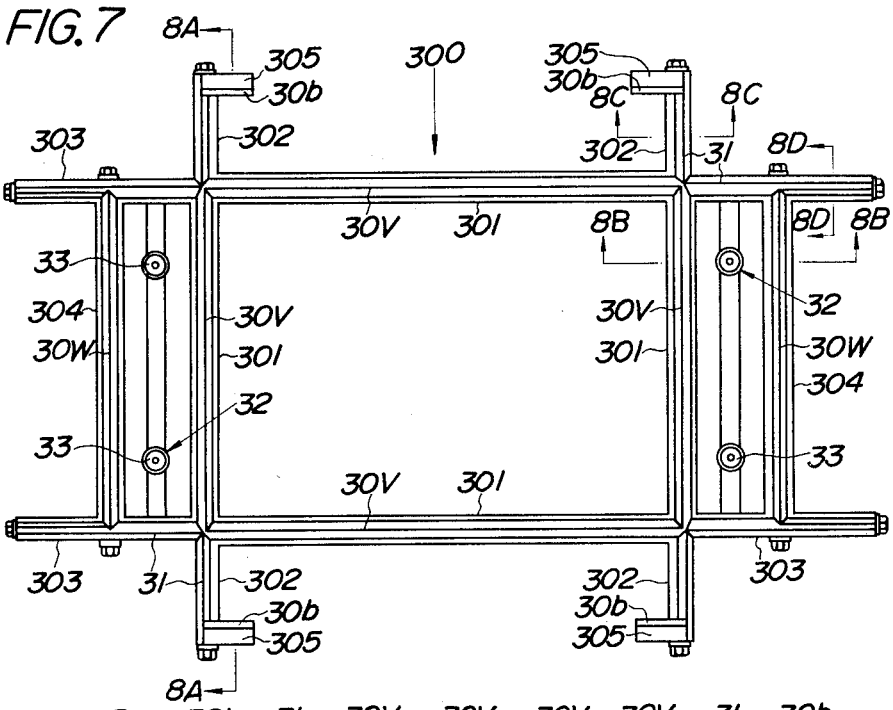
FIG. 7 is a plan view of a heated die, showing the edges thereof, which is used for cutting and impressing the scorings upon the board shown in FIG. 2.
Figure 8:
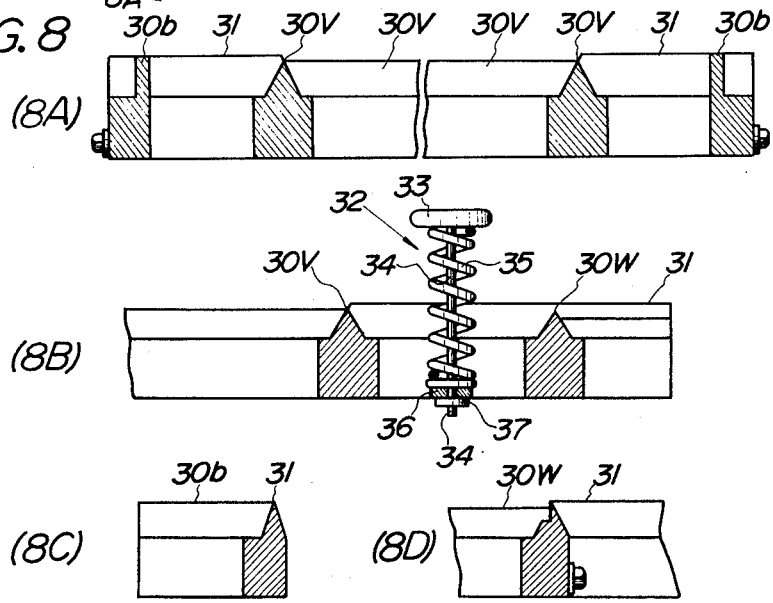
FIGS. 8A – 8D are respectively enlarged sectional views of portions of the heated die shown in FIG. 7, taken along the lines 8A – 8A, 8B – 8B, 8C – 8C, and 8D – 8D thereof.

As shown in FIG. 7, the heat die 300 for cutting, fusing and scoring the thermoplastic sheet so that a plain thermoplastic sheet may be folded into the correct shape of a case or box generally comprises a lattice frame having edges on the surface for acting upon the stock. The edges may be heated with an available source of power, such as, for example, superheated steam, electricity, or hot gases. The lattice frame of the die 300 forms a rectangular frame 301 which includes two longitudinal frames 303 which are disposed in parallel and spaced relationship, two lateral frames 302 which are also disposed in parallel and spaced relationship crossing the longitudinal frames 303 at right angles and defining a rectangular space surrounded by the respective longitudinal and lateral frames 302 and 303. At both terminating ends of the respective lateral frames 302 which are extended beyond the longitudinal frames 303, frames 305 protrude in the inward direction. The longitudinal frames 303 which are extended from the intersection of the lateral frames 302 and the longitudinal frames 303, are connected by additional lateral frames 304 which are parallel and in spaced relationship with the lateral frames 302. Between the respective lateral frames 304 and 302, pushing devices generally indicated by the reference numerals 32 are provided for stripping the heat treated thermoplastic sheet 100 off from the die 300 when it is driven to be out of contact with the stock 100 after finishing the press work. As is more clearly shown in FIG. 8B, the pushing device 32 comprises a disk 33, a rod 34 connected to disk 33, a compression spring 35, a mounting frame 36, and a stop ring 37.

Figure 2:
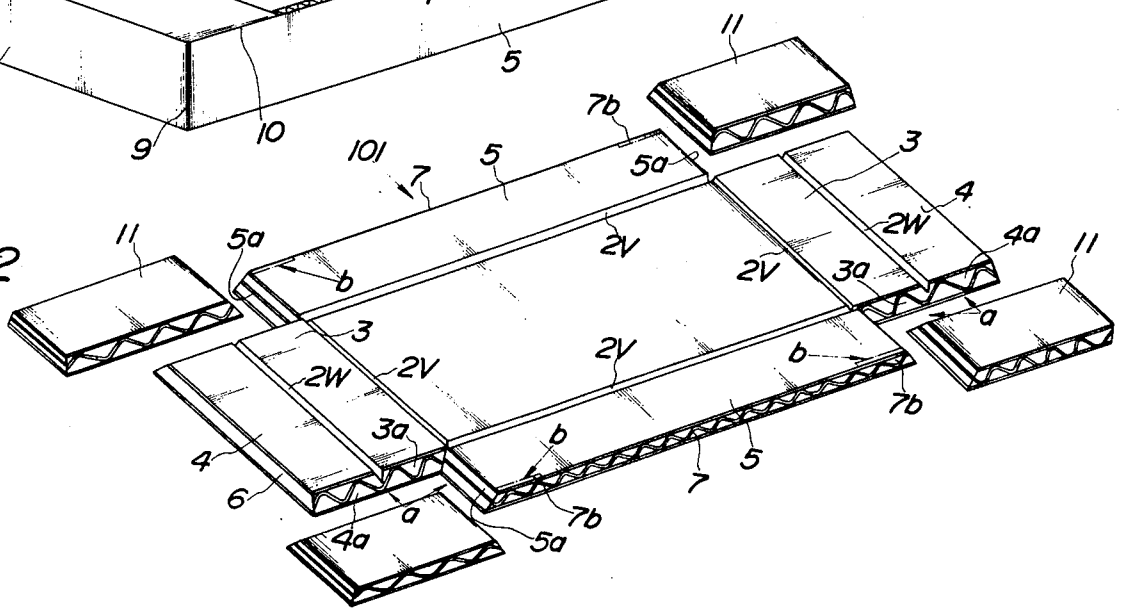
FIG. 2 is an extended perspective view of a sheet of corrugated board supplied to an apparatus for producing the packing case in accordance with the present invention after having unnecessary portions thereof for forming the case melted and cut away and scorings impressed upon the board by pressing with a die.

The frame of the die 300 is constructed as explained above, and heat edges for acting upon the stock are provided on the surface of the frames. Along the surface rectangular frame 301 formed by the lateral and longitudinal frames 302 and 303, a heat edge 30V generally V-shaped in cross section, as shown in FIGS. 8A and 8B is provided. This heat edge 30V is to impress the scorings or grooves 2V, shown in FIG. 2 for defining the bottom wall 2 of the case 1 on the stock 100 and for folding the side walls 3 and 5 along the scorings upwardly. Similarly, on the surfaces of the additional lateral frames 304, heat edges 30W are provided to impress scorings or grooves 2W, shown in FIG. 2, between the side walls 3 and their extension flaps 4, along which the flaps 4 are to be folded inwardly. As shown in FIG. 8B, vertical length of the heat edges 30W may be shorter than that of the heat edges 30V. At the four corners of the frame which are substantially of an L-shape formed by the lateral and the longitudinal frames 302 and 303, cutting edges 31 for fusing and cutting unnecessary portions 11, as shown in FIG. 2, for forming the case 1 are provided. The cutting edges 31 include slanted surfaces for cutting the edges 3*a*, 4*a* and 5*a* of the side walls 3 and 5 by substantially 45° so that the edges 3*a* and 5*a* can be joined at a right angle when the side walls 3 and 5 are folded into an upright position. The vertical length of the cutting edges 31 is longer than that of the heat edges 30V and 30W, as shown in FIGS. 8A – 8D, and is slightly longer than the thickness of the stock to be treated, and the temperature of the cutting edges 31 is maintained higher than that of the remaining edges. At the frames 305 projected inwardly from the projecting ends of the vertical frames 302, hot knives having flat edges 30*b* are provided for melting portions 7*b* of the edges 7 of the side walls 5 so that the side edges 4*a* of the flap 4 melted and cut by the edges 31 may be welded onto the portions 7*b* of the side walls 5 in the case forming operation. The portions 7*b* of the side walls 5 are melted by the hot knives to such an extent that the upper surfaces of the flap and the edges 7 of the side walls 5 become almost level when the flaps 4 are welded to the portions 7*b* of the side walls 5.

Figure 6:
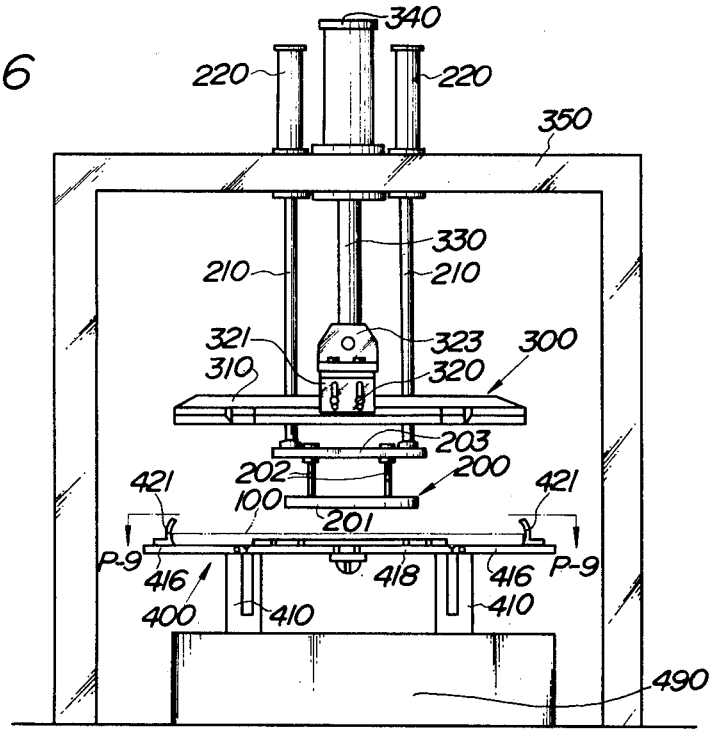
FIG. 6 is a front view of an apparatus for producing a packing case in accordance with the present invention in which an actuating means for the work table has been removed for purposes of illustration.

As shown in FIG. 6, the heat die 300 is connected to a post 330 by means of a fixing plate 310 and a level adjusting device 320 at the rear surface thereof, and a ram 340 for driving the heat die 300 is mounted on a frame 350 above the work table 400. Disposed to the sides of the ram 340 are two pressure cylinders 220, the respective rods 210 of which are connected to a chuck plate 201 having a smooth surface for holding a sheet of stock by means of connecting members 202 and 203. The dimension of the chuck plate 201 is smaller than that of the rectangular frame 301 of the die 300 shown in FIG. 7, such that it can move vertically apart from the vertical motion of the die 300. The cylinders 440, 450, and 460 for actuating the sliding plates 432, the folding plates 416 and 418, and the supporting plates 412 and 414, explained in connection with FIGS. 11 and 12, and the pressure cylinders 220 and the ram 340 are successively operated to maintain a certain time lag in accordance with a predetermined schedule set by timers or switches for detecting the completion of the operation of the apparatus just before running.

The operation of the apparatus in accordance with the present invention described above will now be explained. Firstly, the thermoplastic sheet 100 which is cut to a predetermined size in advance, is fed to the work table 400 from a forward direction of FIG. 6, the eight hinged plates of which are maintained in the same plane, and placed at the setting position on the fold plates, as shown in the phantom line of FIG. 9, the feeding apparatus of the thermoplastic sheet 100 and an apparatus for adjusting the setting position of the sheet not being shown, making the two opposing side edges 6 of the sheet 100 shown in FIGS. 1 and 2 contact with the inner surface 422 of the arcuate guide 421.

In the next step of the operation, the chuck plate 201 is lowered to hold the stock 100 lightly on the work table 400 by actuation of the pressure cylinders 220. Then, the heat die 300 is lowered so as to contact and press the stock 100 by actuation of the ram 340. By pressing the stock 100 with the heat die 300, the unnecessary portions 11 of the stock 100 for forming the case are fused and cut along the cutting edges 31 of the die 300 as shown in FIG. 2, and if necessary, removed from the work table 400 by a suitable cleaning device. At the same time, the scorings or grooves 2V for folding the side walls 3 and 5 of the case 1 along the margins of the bottom wall 2 and the scorings or grooves 2W for folding the flaps 4 inwardly are impressed on the sheet 100 by the heat edges 30V and 30W of the die 300, and the edges of the side walls 5 are partially fused at the edge portions 7*b* by the heat edges 30*b* of the die 300 shown in FIG. 7. Then, the second liner 123 and/or the medium web 122 are melted and welded to the first liner 121 so as to increase the thickness of the first liner 121 along the folding lines of the case and to provide strong corners at the bottom and upper sides of the case when the side walls are folded along their scorings so that the heated and melted walls of the scorings may flow and weld together in folded position.

Figure 12:
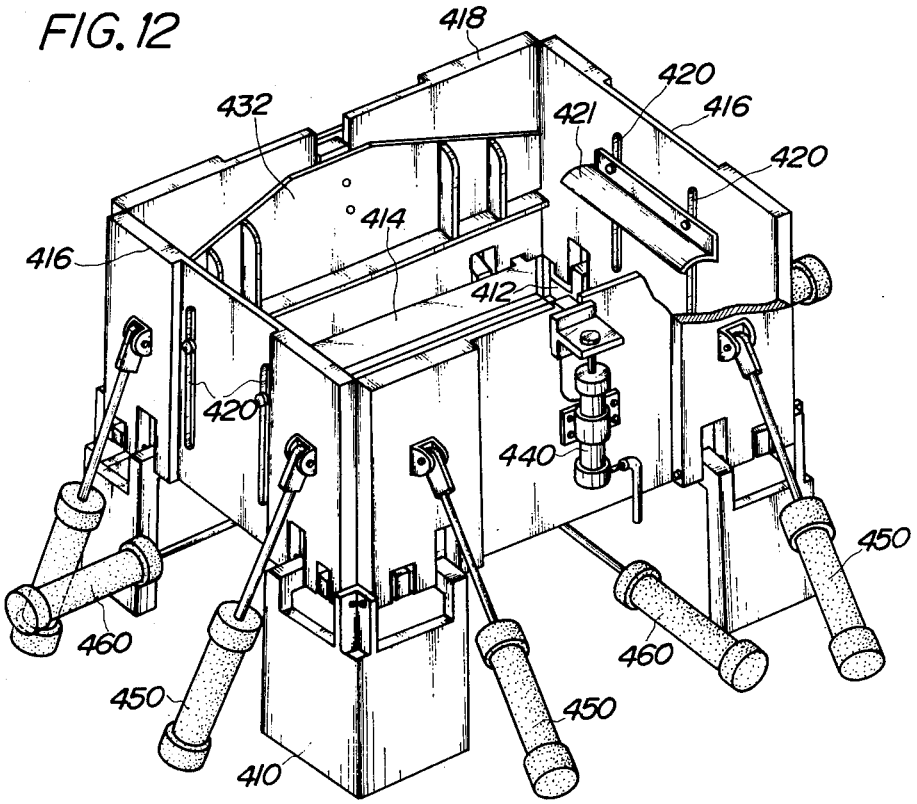
FIG. 12 is a perspective view of the work table showing the erected condition of the fold plates.

The die 300 returns to its original upper position after pressing the stock 100 for a predetermined period of time while maintaining the holding condition of the stock 100 on the work table 400 with the chuck plate 201. After returning of the die 300 to its original position, while the connecting corner edges 3*a*, 4*a*, 5*a* and 7*b* of the stock 100 are in a substantially molten state, each of the cylinders 450 is actuated to fold the plates 416 and 418 upwardly as shown in FIG. 12, causing the edges 3*a* and 5*a* of each of the side walls 3 and 5 to join and be welded together, whereby the corners 9 of the case 1 are formed.

Figure 9:
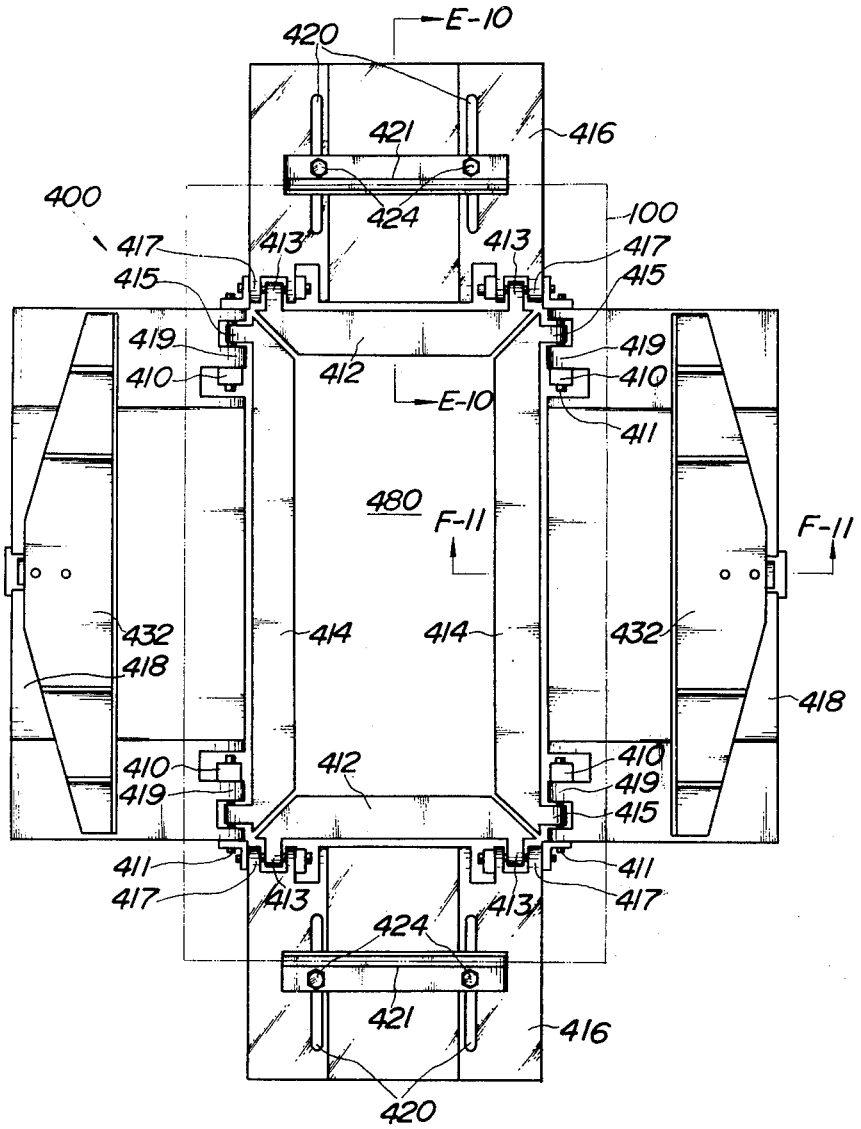
FIG. 9 is a plan view depicted from the line 9—9 of FIG. 6, showing the work table used for the folding operation of the case.
Figure 10:
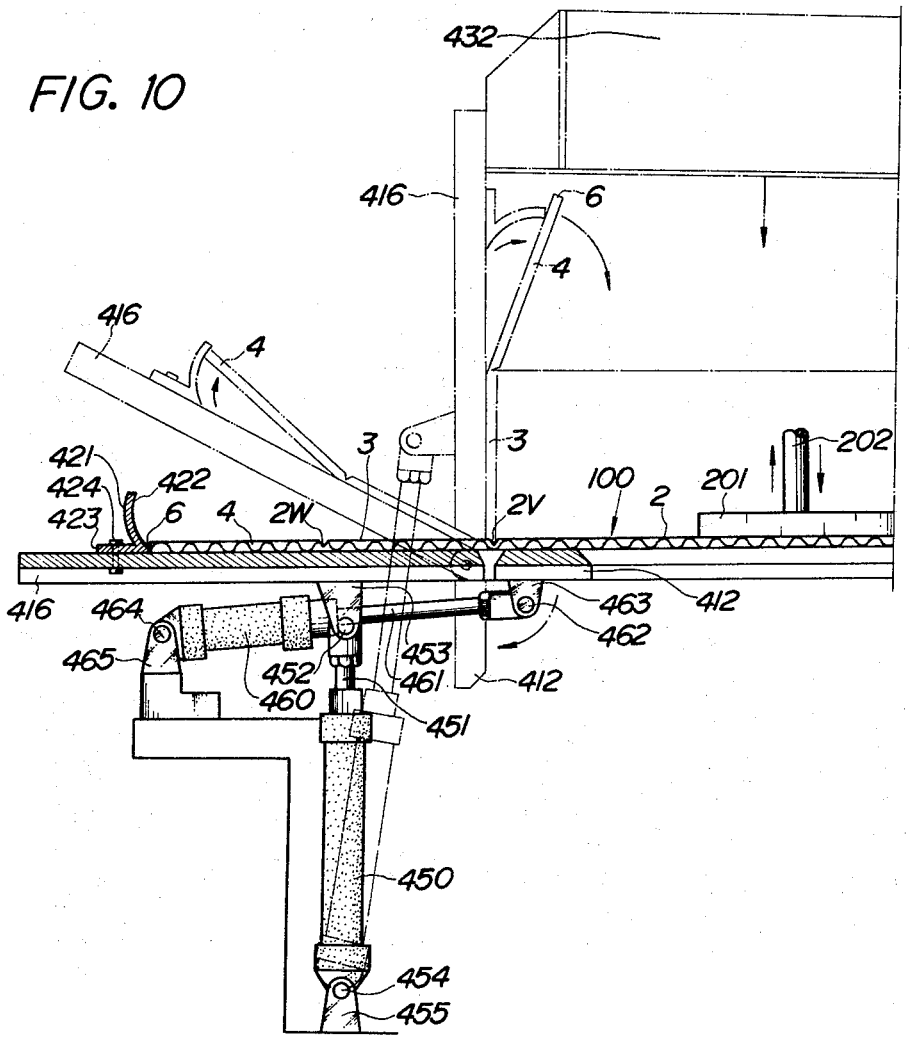
FIG. 10 is an enlarged sectional view taken along the lines 10—10 of FIG. 9 illustrating the process for folding the flaps of the case which are eventually welded at the upper parts thereof.
Figure 13:
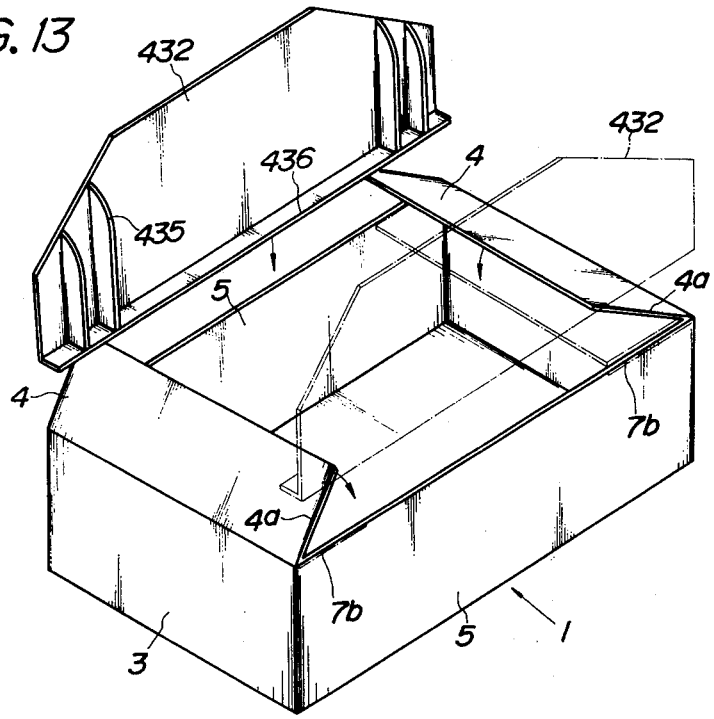
FIG. 13 is a perspective view of the packing case in the course of its production.

Referring to the process for forming the case more in detail with reference to FIGS. 9, 10 and 11, the side walls 5 of the stock 100 are merely folded upward by the fold plates 418, however, the other side walls 3 having the flaps 4 extended therefrom are folded and during such folding, the edges 6 of the flaps 4 are raised up along the inner wall 422 of the arcuate guides 421 as shown in the phantom line of FIG. 10, whereby the flaps 4 are folded inwardly at the grooves 2W. In the upright condition of the plate 416, the edges 6 of the flap 4 are disengaged from the guides 421 and kept in bending condition resting against the terminating edges of the guides 421. Then, the flap pressing plates 432, which are slidable along the inner surfaces of the side wall folding plates 418, are brought down by actuation of the cylinders 460, and press both sides 4*a* of the flaps 4, the contacting surfaces of which are in a molten state, upon the fused upper edges 7*b* of the side walls 5 to be firmly welded, as shown in FIG. 13. After completion of the case, the supporting plates 412 and 414 for the bottom wall 2 of the case 1 are retracted downwardly to provide a delivery chute 480 through which the finished case can be dropped under the work table 400 for delivery. The finished case may be dropped through the chute by pushing it further with the chuck plate 201 or merely under the force of its own weight.

After this operation, the chuck plate 201 moves upwardly, and the four folding plates 416 and 418 for the side walls and the supporting plates 412 and 414 for the bottom wall of the case 1 return to their initial horizontal state ready for the next operation.

As explained above, the apparatus in accordance with the present invention enables the production of a case from a sheet of thermoplastic stock by cutting, melting, folding and welding the stock as it is placed at the setting position of the apparatus, and there is no need to use an adhesive agent in the forming operation, and is particularly useful for such a case made of polyolefine resin and the like for which effective adhesive agents are not yet available. Also, the case may be produced at the point where the packing is being conducted, since the time required for producing the case is extremely short, which eliminates the necessity of transporting and keeping empty boxes. Accordingly, it is possible to produce the cases on a fishing boat at the fishing ground, for example, in accordance with the catch of the fish by setting up the machinery on the boat and loading the blank sheet of the stock with the boat. This permits the space available in the boat to be increased because the space usually necessary for keeping empty boxes are no longer required. In the actual use of the apparatus in accordance with the present invention, it is obvious that the machinery is automatically operated to be connected an automatic feeding apparatus for the stock without operators.

Obviously, many modifications and variations of the present invention are possible in light of the above teachings. It is therefore to be understood that within the scope of the appended claims the invention may be practiced otherwise than as specifically described herein.

What is claimed as new and desired to be secured by Letters Patent of the United States is:

1. An apparatus for producing a packing case from a sheet of thermoplastic material comprising:

a work table having hinged plates spreadable substantially in the same plane for receiving a plane sheet of thermoplastic material thereon and simultaneously foldable to an upright position for folding said sheet of thermoplastic material into the shape of a case;

a die disposed above said work table and moveable onto said thermoplastic sheet overlying said table in contact therewith for melting, cutting and scoring said sheet, having rectangular heat edges for impressing grooves on said sheet defining a bottom wall of said packing case, straight heat edges for impressing grooves on said sheet for defining side walls and flaps of said packing case, L-shaped heat edges for melting and cutting away corners of said sheet, and flat heat edges for melting portions of the side edges of said side walls whereby said side walls may be secured together so as to form said case when said hinged plates are folded to said upright position;

said hinged plates being provided with guide plates for contacting the edges of said sheet and upraising said flap portions of said sheet while folding said flap portions inwardly and with downwardly sliding means for pressing said flaps after being released from said guide plates onto said melting portions of said side edges of said side walls; and actuator means connected to said hinged plates, said sliding members and said die.

2. An apparatus for producing a packing case from a sheet of thermoplastic material according to claim 1, further comprising means for holding said sheet on said work table during the forming operation of said case.

3. An apparatus for producing a packing case from a sheet of thermoplastic material according to claim 2, wherein said means for holding said sheet is positioned within a space surrounded by said rectangular heat edges of said die.

4. An apparatus for producing a packing case from a sheet of thermoplastic material according to claim 2, wherein said means for holding said sheet extends slightly below a level of said work table so as to eject a finished packing case.

5. An apparatus for producing a packing case from a sheet of thermoplastic material according to claim 1, wherein said work table further comprises plates for supporting said bottom wall of said case joined by hinges so as to be able to swing downwardly.

6. An apparatus for producing a packing case from a sheet of thermoplastic material according to claim 1, wherein said hinged plates include a pair of parallel elongated slots through which said guide plates are adjustably secured to said hinged plates by means of bolts.

7. An apparatus for producing a packing case from a sheet of thermoplastic material according to claim 6, wherein said guide plates include arcuate inner guide surfaces.

8. An apparatus for producing a packing case from a sheet of thermoplastic material according to claim 1, wherein said die further comprises pushing means for stripping said heat treated thermoplastic sheet away from the surface of said die when said die is withdrawn.

9. An apparatus for producing a packing case from a sheet of thermoplastic material according to claim 1, wherein said L-shaped heat edges include slanted surfaces at an angle of 45°.

* * * * *